United States Patent [19]

Poore

[11] 4,092,763

[45] June 6, 1978

[54] AIR GUIDE PLATE

[75] Inventor: Thomas C. Poore, Mauldin, S.C.

[73] Assignee: J.P. Stevens & Co., Inc., New York, N.Y.

[21] Appl. No.: 814,824

[22] Filed: Jul. 12, 1977

Related U.S. Application Data

[63] Continuation of Ser. No. 728,655, Oct. 1, 1976, abandoned.

[51] Int. Cl.[2] ..... D01G 15/34; D01G 15/74

[52] U.S. Cl. ..... 19/98

[58] Field of Search ..... 19/98, 106 R, 105

[56] References Cited

U.S. PATENT DOCUMENTS

| | | | |
|---|---|---|---|
| 1,222,733 | 4/1917 | Calderwood | 19/106 R |
| 3,462,799 | 8/1969 | Elliott, Jr. | 19/98 |

FOREIGN PATENT DOCUMENTS

| | | | |
|---|---|---|---|
| 1,421,552 | 11/1965 | France | 19/98 |
| 7,021,301 | 6/1969 | France | 19/106 R |
| 751,965 | 7/1959 | United Kingdom | 19/106 |
| 1,202,034 | 8/1970 | United Kingdom | 19/98 |

*Primary Examiner*—Mervin Stein
*Assistant Examiner*—Andrew M. Falik
*Attorney, Agent, or Firm*—Leitner, Palan & Martin

[57] ABSTRACT

A plate having a plurality of diagonal grooves adjacent opposed lateral edges of the card cylinder for directing air current of a carding machine from the lateral edges towards the center of the leading edge of the main cylinder screen.

15 Claims, 4 Drawing Figures

FIG. 1
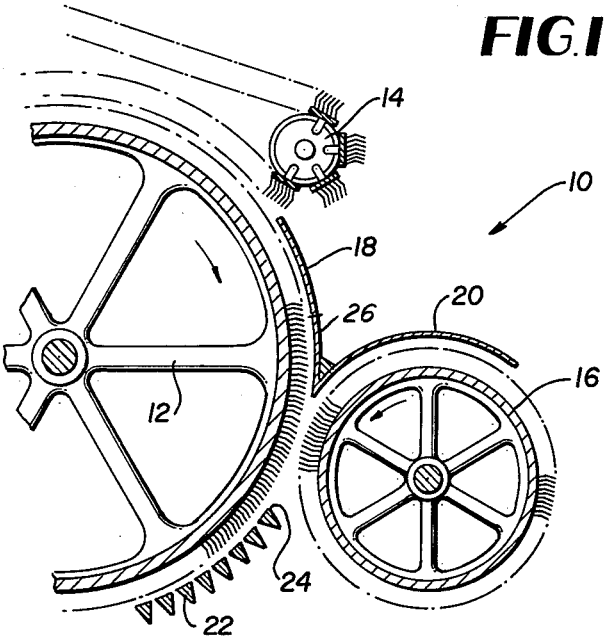
FIG. 2
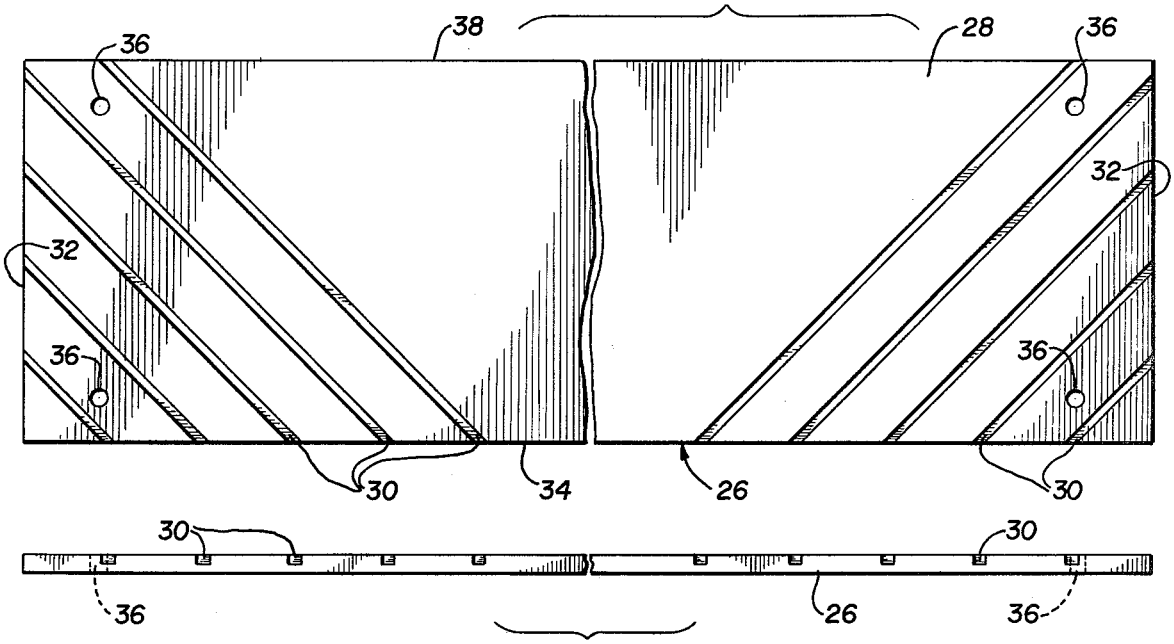
FIG. 3
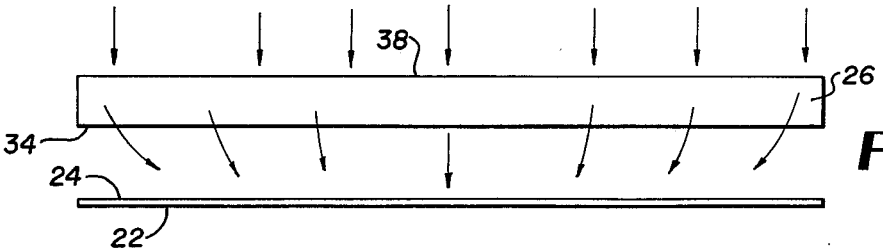
FIG. 4

AIR GUIDE PLATE

This is a continuation of application Ser. No. 728,655, filed Oct. 1, 1976, now abandoned.

BACKGROUND OF THE INVENTION

1. Field of the Invention

The present invention relates generally to carding machines and more specifically to an air guide plate for use at the intersection of the main cylinder and doffer.

2. Description of the Prior Art

In the processing of textile fibers through a card, accumulation of foreign matter at various points on the card interfere with the quality of textile material being produced and intefere with the operation of the carding equipment. Thus continuous cleaning of the equipment and maintenance is required to produce textile material of reliable quality. An area of major concern has been the build-up of foreign matter and waste materials at the intersection of the main carding cylinder and the doffer.

In order to remove the foreign matter from this area, U.S. Pat. No. 3,444,593 modifies the shrouds surrounding this area and uses a suction to remove the materials.

Another attempt to control the air at this intersection is described in U.S. Pat. No. 3,357,062 wherein the cover plates are redesigned so as to carry the foreign material to an outlet duct. This patent also discusses that the lower edge of the main cylinder cover plate is concave from the ends adjacent the card arching towards the center portion with respect to the width of the card. The purpose is to induce the direction of air away from the sides of the carding machine as it is moved towards the exit duct above the doffer. Though the concave configuration does produce a center directing air current, it also produces undesirable side effects in the material being carded.

Another attempt to prevent undesirable effects at the intersection of the main carding cylinder and doffer is disclosed in U.S. Pat. No. 3,362,047. Therein the snagging, ragged selvage or "snowballs", at the leading edge of the screen, are eliminated by beveling the corners of the leading edge of the main cylinder screen.

The prior art has provided many solutions for removing and preventing accumulation of foreign material and debris at the intersection of the main cylinder and the doffer and at the leading edge of the main cylinder screen. These devices, though attempting to solve the problem by bowing the plate, have lost control of the air currents and thereby introduced undesirable side effects including loss of efficiency. Thus there exists a need to efficiently prevent build-up of foreign material at the leading edge of the main cylinder screen and at the intersection of the main cylinder and doffer without introducing additional substantial side effects.

SUMMARY OF THE INVENTION

The air guide plate of the present invention eliminates foreign material and snagging or tagging of material at the leading edge of the screen of the main carding cylinder without introducing undesirable side effects. The air guide plate has at least two non parallel grooves in its surface extending diagonally toward the center of the plate. Preferably the grooves are a plurality of grooves extending from adjacent each lateral edge of the plate. The grooves form angles relative to the direction of the undisturbed bed air flow or current so as to direct the air flow or current from the lateral edge of the main cylinder screen towards the center of the leading edge of the card cylinder. The grooves are inclined at an angle relative to the air flow of from thirty to sixty degrees. The grooves have a depth of up to approximately one-half the thickness of the plate and are spaced from each other by a distance greater than the width of the grooves. The surface of the plate in which the grooves are formed is uniformly spaced from the main carding cylinder along any longitudinal axis of the plate.

OBJECTS OF THE INVENTION

Object of the present invention is to provide a device for reducing the chokes and blow-out at the main cylinder screen of a carding machine.

Another object is to provide a device for eliminating the build-up of foreign material at the leading edge of the main cylinder screen without the introduction of undesirable side effects in the carding process.

A further object of the invention is to provide a plate which produces air currents converging towards the center of the leading edge of the main cylinder screen of a carding machine which is not bowed relative to the longitudinal axis of the main carding cylinder.

Still another object is to provide an air directing device for use in a carding machine which does not require a source of pneumatic pressure.

An even further object of the invention is to provide an air guide means for a carding machine which may be installed in existing machines without modification.

Other objects, advantages and novel features of the present invention will become apparent from the following detailed description of the invention when considered in conjunction with the accompanying drawings.

BRIEF DESCRIPTION OF THE DRAWINGS

FIG. 1 is a side diagrammatic view illustrating the intersection of the main carding cylinder and the doffer of a carding machine.

FIG. 2 is a top plan view of an air guide plate employing the principles of the present invention.

FIG. 3 is a side view of the air guide plate of FIG. 2.

FIG. 4 is a schematic presentation of the air flow or current between the air guide plate and the leading edge of the main cylinder screen.

DESCRIPTION OF THE PREFERRED EMBODIMENTS

As diagrammatically illustrated in FIG. 1, a carding machine 10 generally includes a main carding cylinder 12 having revolving or stationary flats 14 and a doffer 16. Above the tangential intersection of main cylinder 12 and doffer 16 is a cylinder cover or front knife plate 18 and a doffer cover 20. Below the intersection of the main cylinder 12 and doffer 16 is the main cylinder screen 22 having a leading edge 24.

In the normal operation of the card machine 10, material to be processed is carried in a clockwise direction by the main cylinder 12 and processed by the flats 14. The major portion of the material is then removed from the main cylinder 12 by the doffer 16 which rotates in a counter clockwise direction. Although the major portion of the material is removed from the main cylinder 12, some fibers remain thereon and are transmitted down over the main cylinder screen 22. As the fibers remaining on the main cylinder 12 pass over the main cylinder screen 22, they have a tendency to tag, snag, or build-up on the leading edge 24 on the main cylinder screen 22. The build-up of fibers at the leading edge 24 results not only in a blockage of this area, but also effects the surface of cylinder 12 which will produce, in the next revolution, undesirable effects in the material to be processed.

The normal clockwise revolution of the main cylinder 12 relative to the cylinder cover plate 18 and main cylinder screen 22 provides parallel circumferal streams of air current. These air currents cause the material not removed by doffer 16 to intersect the leading edge 24 perpendicularly. This perpendicular intersection has a tendency to increase tagging and build-up of waste material at the leading edge 24 of the main cylinder screen 22. As noted previously, attempts have been made to modify the air flow at the leading edge 24 by bowing or forming the lower edge of cover plate 18 such as to produce air currents which will intersect the leading edge 24 of the main cylinder screen 22 at an angle other than ninety degrees and thereby reduce the tagging, snagging, and build-up of undesirable materials. Though reducing the build-up of waste material at the leading edge 24, bowing the edge of cylinder cover plate 18 produces uncontrolled air currents which disturb the fibers on the main cylinder 12 at the intersection of the main cylinder 12 and the doffer 16 and could produce ragged selvage.

An air guide plate 26, illustrated in FIGS. 2 and 3, provides the air flow intersecting the leading edge 24 of screen 22 at an angle other than ninety degrees thereto without producing the undesirable side effects produced by bowed cover plates. Air guide plate 26 has a surface 28 in which are provided a plurality of grooves 30 adjacent each lateral edge 32 of the plate. The grooves 30 are illustrated as forming an angle relative to the lower longitudinal edge 34 of plate 26. A plurality of openings 36 are provided adjacent the lateral edges 32 so that the plate 26 may be mounted as the lowermost portion of the main cylinder cover 18 by appropriate fasteners. Since the main cylinder cover 18 is normally made up of three parts—namely, the top plate, the stripping door and the bottom plate—the air guide plate 26 can be mounted to the brackets or any other part of the cover in place of the bottom plate without modification of the carding machine.

The grooves as illustrated are separated by a greater distance than the width of the groove and the depth of the grooves may be up to approximately one-half the thickness of the plate 26. By separating the grooves 30 by a distance greater than the width of the grooves, the turbulence which could result is reduced and consequently each groove operates more efficiently to redirect the air current. Though the grooves 30 are illustrated as having rectangular cross-sections, other cross-sections may be used.

The angle the grooves make relative to the undisturbed air flow, which is generally parallel to lateral edges 32 and generally perpendicular to the longitudinal edge 34, may vary between thirty and sixty degrees, though angles of forty-five degrees or smaller are preferred. Selection of the appropriate angle, the number of grooves at each lateral edge, the depths of the grooves, the widths of the grooves, the distance of separation of the grooves, the cross-sectional shape of the grooves and the length of the lateral edge 32 will be determined for the individual carding machines depending upon their characteristics and the desired air currents to be produced at the leading edge 24 of the main cylinder screen 22. For example, a plate was built wherein the lateral edge 32 was five inches, the width and depth of rectangular cross-sectioned grooves 30 were an eighth of an inch with a three-quarter of an inch separation between grooves, and the thickness of the plate was one quarter of an inch. These are mere examples of one physical embodiment of an air guide plate incorporating the principles of the present invention, which has been used successfully on a Whitin model H and a Saco-Lowell carding machine.

Depending upon the length of lateral edge 32, the surface 28 of plate 26 may be totally flat or planar or may involve a curvature along the lateral edge 32. Irrespective of the curvature along the lateral edge 32, there should be no curvature along the longitudinal axis of the surface 28. To be more specific, along any longitudinal axis of surface 28 of plate 26 each point on that longitudinal axis should be uniformly spaced from the surface of main cylinder 12. Since the redirecting of air currents from parallel to an air current converging from the lateral edges 32 towards the center is produced by grooves 30 in surface 28 of plate 26, no bowing or curvature along the longitudinal axis is required. The elimination of this bowing also eliminates the corresponding detrimental effects at the surface of main cylinder 12 and at the intersection of main cylinder 12 and doffer 16.

The effects of the grooves 30 in surface 28 of plate 26 are illustrated schematically in FIG. 4. The undisturbed air flow or air currents are substantially parallel upon reaching the upper longitudinal edge 38 of plate 26. As the air currents leave the lower longitudinal edge 34 of plate 26, the air currents adjacent the lateral edges 32 are directed so as to converge towards the center air currents. This converging or diagonal motion continues to effect the center air currents which leave the lower longitudinal edge 34 substantially parallel to each other to cause a substantial amount of these parallel air currents to also converge by the time they reach the leading edge 24 of screen 22. Thus a substantial portion of the air currents reaching the leading edge 24 of screen 22 intersect this leading edge at an angle relative thereto other than ninety degrees. Only a small portion of the center air currents still intersect the leading edge 24 perpendicular thereto. The converging or nonperpendicular air flow at the leading edge 24 causes any material which would intersect the edge 24 and snag thereat to be moved along the leading edge 24 and eventually be transmitted past the edge 24 without undesirable build-ups and be removed through the main cylinder screen 22.

The reduction of undesirable snagging or building-up of waste material at the leading edge 24 of the main cylinder screen 22 increases the efficiency of the machine, reduces the amount of maintenance and allows increase of speed thus increasing productivity.

From the preceding description of the preferred embodiments, it is evident that the objects of the invention are attained in that an air guide plate is provided which is uniformly spaced from the surface of the card cylinder while producing air currents which converge from the opposed lateral edges of the card cylinder towards the center of the main cylinder screen without producing undesirable effects on the card cylinder and intersection of the main cylinder with the doffer. Although the invention has been described and illustrated in detail, it is understood that the same is by way of illustration and example only and is not to be taken by way of limitation. The spirit and scope of this invention being limited only by the terms of the appended claims.

What is claimed:

1. A card machine air guide plate comprising a surface having a plurality of grooves substantially adjacent a pair of opposed lateral edges of said plate, each of said grooves forming an angle relative to said lateral edges for directing air flow across said surface from each of said opposed lateral edges towards the portion of said surface between said opposed lateral edges.

2. The air guide plate according to claim 1 wherein said angle is between thirty to sixty degrees.

3. The air guide plate according to claim 1 wherein said grooves are separated from each other by a distance greater than the width of a groove.

4. The air guide plate according to claim 1 wherein said plate is rectangular and substantially planar, said opposed lateral edges are substantially parallel to the direction of undisturbed air flow of a carding machine.

5. In a carding machine having a main carding cylinder, a main cylinder screen beneath said cylinder, and a doffer, the improvement comprising a plate means positioned adjacent the tangential intersection of said cylinder and said doffer for directing the air current at the leading edge of said screen at an angle relative to the edges of said screen toward the center of said screen, said plate means including a plurality of grooves in the surface adjacent said cylinder for directing said air current.

6. The improvement of claim 5 wherein said plurality of grooves are substantially adjacent the lateral edges of said plate means and are inclined relative to the direction of undisturbed air current of said carding machine.

7. The improvement of claim 6 wherein said surface of said plate means is uniformly spaced from said cylinder along any longitudinal axis of said surface.

8. The improvement of claim 6 wherein said grooves are inclined at an angle of 30° to 60° relative to their respective lateral edge.

9. The improvement of claim 6 wherein said plurality of grooves are separated from each other by a distance greater than the width of a groove.

10. A carding machine air guide plate comprising a surface having lateral edges and first and second longitudinal edges and at least two grooves which are not parallel to each other and which are not parallel to any of the edges, and said grooves extending toward the center of the second longitudinal edge of the plate, for directing air toward the center.

11. The air guide plate according to claim 10 wherein said grooves extend at angle between 30° to 60° relative to said second longitudinal edge.

12. The air guide plate according to claim 10 including a first and second group of grooves, grooves of said first group are not parallel to grooves of said second group and none are parallel to any of the edges.

13. The air guide plate according to claim 12 wherein the grooves in a group are separated from each other by a distance greater than the width of a groove.

14. The air guide plate according to claim 10 wherein said plate is rectangular and substantially planar, said lateral edges are substantially parallel to the direction of undisturbed air flow of a carding machine.

15. The air guide plate according to claim 10 wherein said first longitudinal edge is the leading edge relative to the direction of air flow of a carding machine and said second longitudinal edge is the trailing edge relative to said air flow.

* * * * *

UNITED STATES PATENT AND TRADEMARK OFFICE

CERTIFICATE OF CORRECTION

PATENT NO. : 4,092,763
DATED : June 6, 1978
INVENTOR(S) : Thomas C. Poore

It is certified that error appears in the above-identified patent and that said Letters Patent are hereby corrected as shown below:

Column 3, line 8 Delete "circumferal" and insert therefor --circumferential--.

Column 4, line 35 Delete "effect" and insert therefor --affect--.

Column 5, line 4 Delete "card" and insert therefor --carding--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*